US006097819A

United States Patent [19]

Chang et al.

[11] Patent Number: 6,097,819

[45] Date of Patent: Aug. 1, 2000

[54] METHOD FOR TESTING NOISE OF A RECORD/PLAY-BACK LOOP IN A COMPUTER AUDIO SYSTEM

[75] Inventors: Vam Chang, Taipei, Taiwan; Judith Xi, Shang Hai, China

[73] Assignee: Inventec Corporation, Taipei, Taiwan

[21] Appl. No.: 09/225,307

[22] Filed: Jan. 5, 1999

[30] Foreign Application Priority Data

Oct. 23, 1998 [TW] Taiwan ..... 87117569

[51] Int. Cl.[7] ..... H04R 29/00

[52] U.S. Cl. ..... 381/58; 381/56; 700/94

[58] Field of Search ..... 381/56, 58, 59, 381/119, 122, 124, 94.1, 94.2, 94.3, 94.7, 103; 379/1, 5, 6; 324/527; 704/94; 364/400.01

[56] References Cited

U.S. PATENT DOCUMENTS

| | | | |
|---|---|---|---|
| 4,306,113 | 12/1981 | Morton | 381/58 |
| 4,773,094 | 9/1988 | Dolby | 381/58 |
| 5,377,277 | 12/1994 | Bisping | 381/94.3 |
| 5,553,220 | 9/1996 | Keene | 381/150 |
| 5,555,311 | 9/1996 | Reams | 381/58 |
| 5,832,438 | 11/1998 | Bauer | 381/103 |
| 5,915,029 | 6/1999 | Yazurlo et al. | 381/58 |

FOREIGN PATENT DOCUMENTS

| | | | |
|---|---|---|---|
| 2279542 | 4/1995 | United Kingdom | 381/58 |

*Primary Examiner*—Forester W. Isen
*Assistant Examiner*—Xu Mei
*Attorney, Agent, or Firm*—Bacon & Thomas, PLLC

[57] ABSTRACT

A method for testing noise of a record/play-back loop in an audio system of a personal computer (PC) system is disclosed. The audio system comprises an analog-to-digital (A/D) converter, an FM synthesizer, an FM register, a mixer, an output device, an input device, and a connection element connected between the output device and the input device. The PC system has a system bus for communicating with the A/D converter and the FM synthesizer. The method comprises the steps of: (a) the PC system is started to issue a command to the FM synthesizer to output a sinusoidal analog signal to the output device via the mixer; (b) the analog signal is outputted to the input device via the connection element and then is outputted to the A/D converter for being converted to a digital signal which further stored as a digitized audio document; (c) the PC system performs a mathematical analysis on the audio document in order to calculate a signal-to-noise (S/N) ratio and a signal distortion of the record/play-back loop; and (d) the S/N ratio and the signal distortion described in step (c) are compared with a pair of predetermined standards respectively in order to determine that whether the S/N ratio and the signal distortion meet the predetermined standards.

7 Claims, 2 Drawing Sheets

METHOD FOR TESTING NOISE OF A RECORD/PLAY-BACK LOOP IN A COMPUTER AUDIO SYSTEM

BACKGROUND OF THE INVENTION

1. Field of the Invention

The present invention relates to a computer test method, and more particularly to a method for testing noise of a record/play-back loop in a computer audio system. The method comprises the steps of: (a) the FM synthesizer outputs a sinusoidal analog signal to the output device via the mixer; (b) the analog signal is outputted to an input device via a connection element and then is outputted to the A/D converter for being converted to a digital signal which further stored as a digitized audio document; (c) the system performs a mathematical analysis on the audio document in order to calculate a signal-to-noise (S/N) ratio and a signal distortion of the record/play-back loop; and (d) the S/N ratio and the signal distortion described in step (c) are compared with a pair of predetermined standards respectively in order to determine that whether the S/N ratio and the signal distortion meet the predetermined standards.

2. Background Information

Conventionally, the sound of a personal computer (PC) speaker is monotonous. However, the emergence of computer audio system has completely change that. It can play easy listening music and even produce various sound effects to let consumers enjoy realistic sound.

It is known that a good audio system is a must for upgrading an ordinary PC to a PC with multimedia feature. Therefore, many potential computer buyers view a PC with a good audio system as a top selection priority. It is also known that an analog to digital (A/D) converter of the computer audio system is the most important device for recording or playing sound and music.

It is found that a poor A/D converter is blamed for disharmonious sound as well as for the distortion of original sound effect recorded. This is quite not desirable for a computer consumer. Accordingly, the manufacturer conducts a series of tests on the A/D converter as a part of the quality control process for judging the goodness of recording and playing features of the A/D converter. The most important test of them is the test on the A/D converter. Traditionally, the A/D converter test is conducted in either way:

(a) Manually conducted by a test person, i.e., the test person judges the sound quality of the tested A/D converter by ear, but this is unsatifactory for the following reasons:

1. Relies on experiences and personal judgment of the test person and thus quite unreliable due to personal factors;
2. There is no common test rule and thus test results between two persons sometimes are different, i.e., the deviation is too large and unacceptable; or (b) Use an oscilloscope that visually display an electrical wave of the tested A/D converter, but this is unsatifactory for the following reasons:

1. The test procedure is time consuming;
2. A trained test person is required;
3. The cost is higher.

Thus, it is desirable to provide a method for testing noise of a record/play-back loop in a computer audio system with the advantages of being objective, repeatable, adjustable, convenient, time saving and cost saving.

SUMMARY OF THE INVENTION

It is therefore an object of the present invention to provide a method for testing noise of a record/play-back loop in a computer audio system. The audio system comprises an analog-to-digital (A/D) converter, an FM synthesizer, an FM register, a mixer, an output device, an input device, and a connection element connected between the output device and the input device. The PC system has a system bus for communicating with the A/D converter and the FM synthesizer. The method comprises the steps of: (a) the PC system is started to issue a command to the FM synthesizer to output a sinusoidal analog signal to the output device via the mixer; (b) the analog signal is outputted to the input device via the connection element and then is outputted to the A/D converter for being converted to a digital signal which further stored as a digitized audio document; (c) the PC system performs a mathematical analysis on the audio document in order to calculate a signal-to-noise (S/N) ratio and a signal distortion of the record/play-back loop; and (d) the S/N ratio and the signal distortion described in step (c) are compared with a pair of predetermined standards respectively in order to determine that whether the S/N ratio and the signal distortion meet the predetermined standards.

It is an another object of the present invention to provide a test method for accurately determining the goodness of a computer audio system while without the use of an oscilloscope and/or the participation of a trained test person.

The above and other objects, plus features and advantages of the present invention will become apparent from the following detailed description taken with the accompanying drawings.

DETAILED DESCRIPTION OF THE PREFERRED EMBODIMENTS

Figure 1:
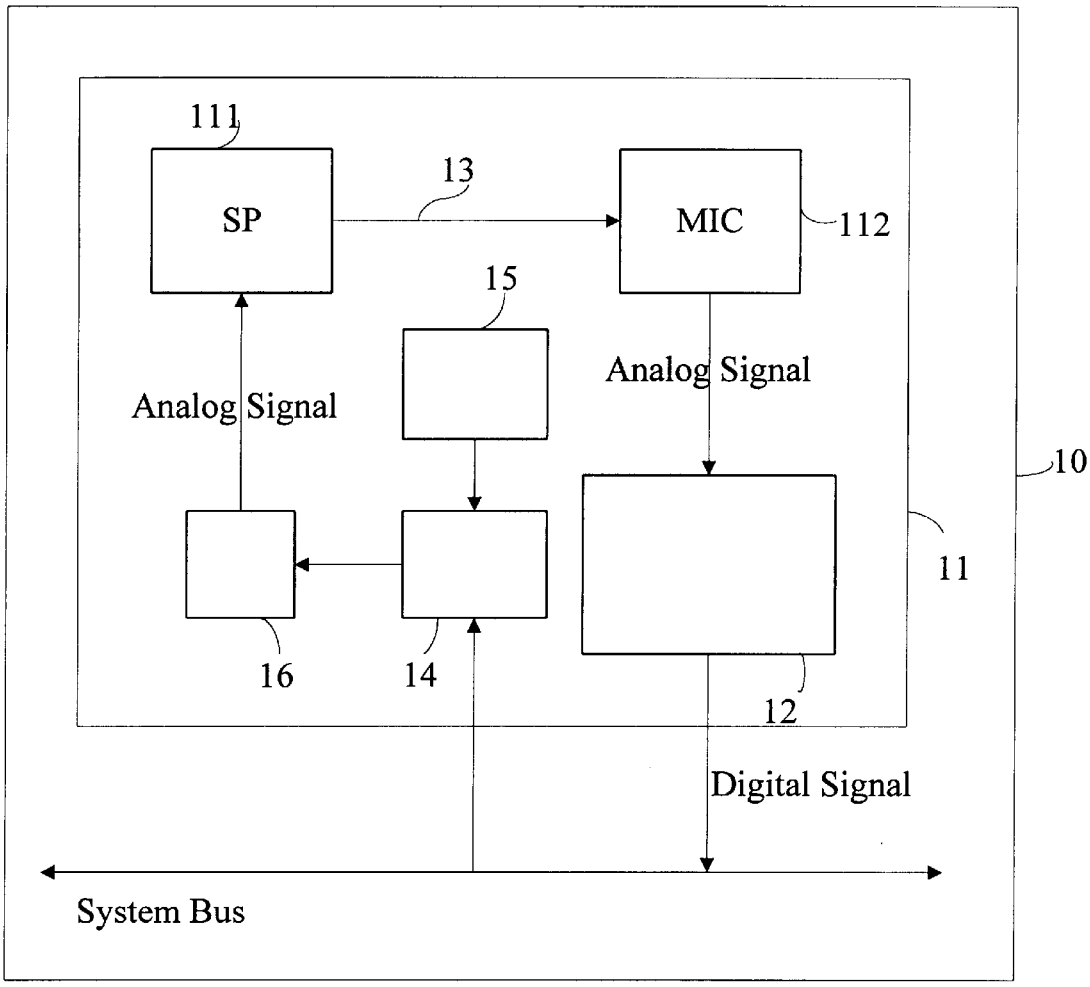
FIG. 1 is a block diagram of a PC system configured in accordance with the present invention.

Referring to FIG. 1, a PC system 10 is shown in accordance with the present invention. The PC system 10 comprises an audio system 11 of a PC (not shown), a system bus and other associated devices (not shown). The audio system 11 comprises an A/D converter 12, a connection element 13, an FM synthesizer 14, an FM register 15, a mixer 16, an output device such as a speaker 111, and an input device such as a microphone 112. The connection element 13 is connected between the speaker 111 and the microphone 112. The connection element 13 is a commercial available audio cable in a general condition. However, it is also allowed to add a number of matching circuits into it when impedance match is taken into consideration. The A/D converter 12 and the FM synthesizer 14 of the audio system 11 are communicated with the PC system 10 by way of the system bus.

Figure 2:
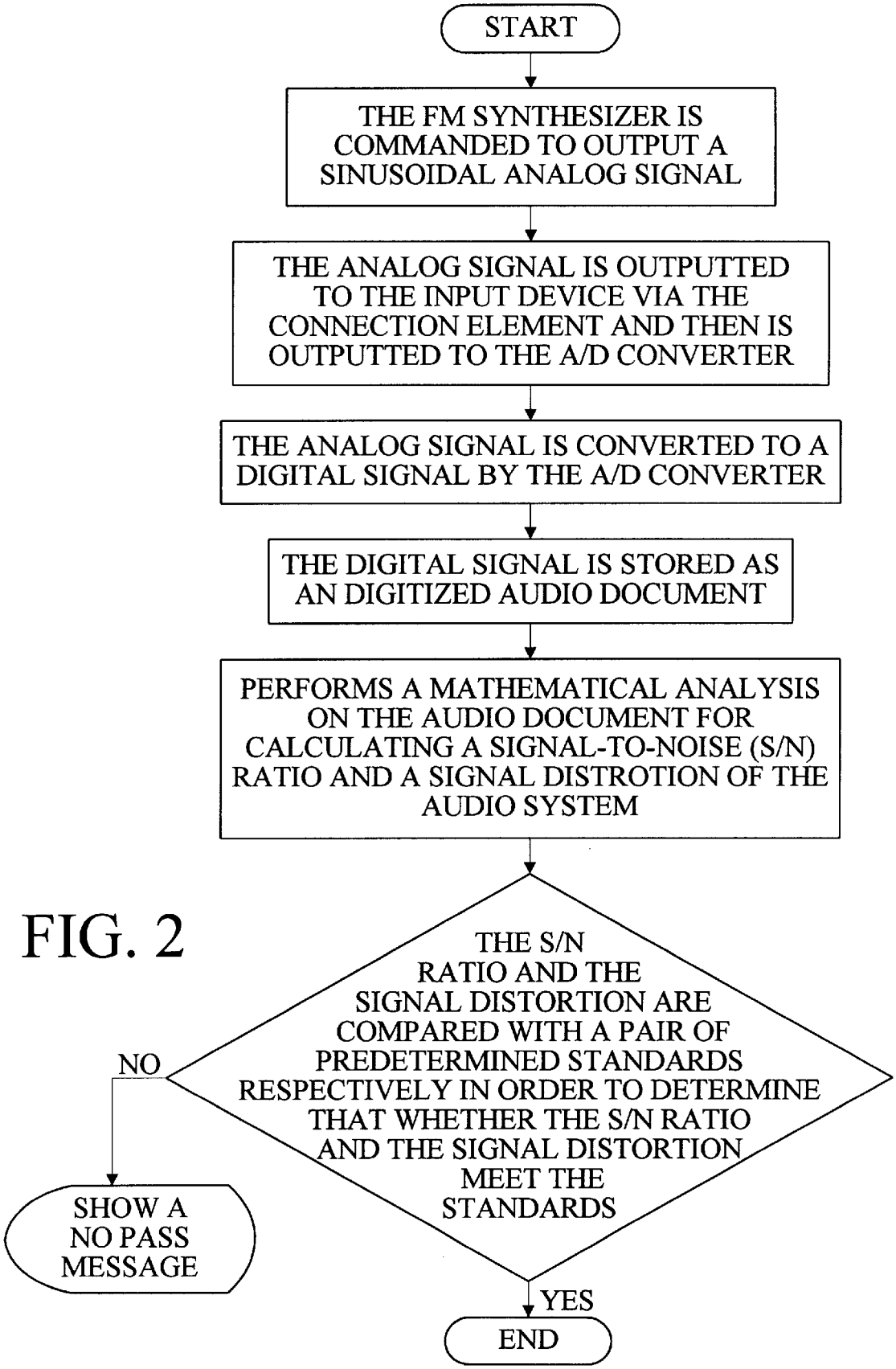
FIG. 2 is a flowchart describing the operation of the PC system.

Referring now to FIG. 2, a flowchart of steps taken to perform the operation of the PC system 10 is provided. First, the PC system 10 is started to perform an embedded test software.

In step 200, the PC system 10 issues a command to the FM synthesizer 14 through the system bus. The FM synthesizer 14 is commanded to output a sinusoidal analog signal with a frequency calculated as follows:

$$\text{BaseFre}=\text{F_Number}\times(2\times 2^{(20-Block)}\times 49716) \quad (1)$$

$$\text{Frequency}=\text{BaseFre}\times\text{Multi} \quad (2)$$

where F_number is tone frequency index, BaseFre is base frequency, Block is tone index, Multi is a multiple of frequency, and Frequency is sinusoidal analog signal frequency. It is noted that the F_number, the Block, the BaseFre and the Multi are prewritten into the FM register 15 which is summarized in table I.

TABLE I

Status of the FM Register

| FM Register Offset (in hexadecimal) | Written Value |
|---|---|
| 20h | Multi\|0×20 |
| 40h | 0 |
| 60h | 0×f0 |
| 80h | 0×0f |
| E0h | 0 |
| A0h | F_Number&0×ff |
| C0h | 0 |
| B0h | 0×20\|(Block<<2)\|(F_Number>>8) |

Consequently, the analog signal outputted from the FM synthesizer 14 is inputted to the speaker 111 through the mixer 16.

In step 202, the analog signal inputted to the speaker 111 is outputted to the microphone 112 via the connection element 13 and then is outputted to the A/D converter 12.

In step 204, the analog signal is converted to digital signal by the A/D converter 12.

In step 206, the digital signal is stored as a digitized audio document in memory (not shown) of the A/D converter 12.

In step 208, the PC system 10 performs a mathematical analysis on the digitized audio document in order to calculate a signal-to-noise (S/N) ratio and a signal distortion of the record/play-back loop of the audio system 11.

It is known that the A/D converter 12 digitizes the analog signal in a pulse code modulation (PCM) form in order to conduct an analog to digital conversion. It is noted that the sinusoidal analog signal is sampled in each time slot. Therefore, the stored digitized audio document is a quantified sum of each sample.

First, the PC system 10 performs a differentiation on the data stored on the audio document to compare a waveform of the audio document with a predetermined waveform so as to quantify a deviation between them (if any). The quantified deviation is the signal distortion of the record/play-back loop of the audio system 11.

Consequently, the PC system 10 performs an integration on the data stored on the audio document to obtain a total signal power. The total signal power is compared with the total signal power when output of the speaker 111 is zero. The ratio is the S/N ratio of the record/play-back loop of the audio system 11.

In step 210, the S/N ratio and the signal distortion of the record/play-back loop of the audio system 11 previously obtained in step 208 are compared with a pair of predetermined standards (set by a test person) respectively in order to determine that whether the S/N ratio and the signal distortion meet the predetermined standards. If yes, operation will end. If not, operation will then continue with step 212 to show a "no pass message" and operation will end either.

While the invention herein disclosed has been described by means of specific embodiments, numerous modifications and variations could be made thereto by those skilled in the art without departing from the scope of the invention set forth in the claims.

What is claimed is:

1. A method for testing noise of a record/play-back loop in an audio system of a personal computer (PC) system, the audio system comprises an analog-to-digital (A/D) converter, an FM synthesizer, an FM register, a mixer, an output device, an input device, and a connection element connected between the output device and the input device, the PC system has a system bus for communicating with the A/D converter and the FM synthesizer, comprising the steps of:

(a) the PC system is started to perform an imbedded test software, and then the PC system issues a command to the FM synthesizer to output a sinusoidal analog signal to the output device via the mixer;

(b) the analog signal is outputted to the input device via the connection element and then is outputted to the A/D converter;

(c) the analog signal is converted to a digital signal by the A/D converter;

(d) the digital signal is stored as an digitized audio document in the A/D converter;

(e) the PC system performs a mathematical analysis on the digitized audio document in order to calculate a signal-to-noise (S/N) ratio and a signal distortion of the record/play-back loop of the audio system; and (f) the S/N ratio and the signal distortion described in step (e) are compared with a pair of predetermined standards respectively in order to determine that whether the S/N ratio and the signal distortion meet the predetermined standards.

2. The method of claim 1, wherein the sinusoidal analog signal outputted from the FM synthesizer having a frequency calculated as follows:

$$\text{BaseFre}=\text{F_Number}\times(2\times2^{(20-Block)}\times49716)$$

$$\text{Frequency}=\text{BaseFre}\times\text{Multi}$$

where F_number is tone frequency index, BaseFre is base frequency, Block is tone index, Multi is a multiple of frequency, and Frequency is sinusoidal analog signal frequency.

3. The method of claim 2, wherein the F_number, the BaseFre, the Block and the Multi are prewritten into the FM register for providing to the FM synthesizer.

4. The method of claim 1, wherein the digitized audio document is a quantified sum of each analog signal sample which sampled in each time slot.

5. The method of claim 1, wherein the A/D converter digitizes the analog signal in a pulse code modulation (PCM) form in order to conduct an analog to digital conversion.

6. The method of claim 1, wherein the PC system performs a differentiation on the data stored on the audio document to compare a waveform of the audio document with a predetermined waveform so as to quantify a deviation between them as the signal distortion of the record/play-back loop.

7. The method of claim 1, wherein the PC system performs an integration on the data stored on the audio document to obtain a total signal power which compared with the total signal power when output of the output device is zero so as to obtain a ratio as the S/N ratio of the record/play-back loop.

* * * * *